US006026870A

United States Patent [19]

Liu

[11] Patent Number: 6,026,870

[45] Date of Patent: Feb. 22, 2000

[54] WORKPIECE SUPPORTING ASSEMBLY OF CARPENTER'S PLANE

[76] Inventor: Ming-Huang Liu, No. 50-2, Ta Chou Road, Shen Kang Hsian, Taichung Hsien, Taiwan

[21] Appl. No.: 09/201,251

[22] Filed: Nov. 30, 1998

[51] Int. Cl.[7] ..... B27C 1/14; B27C 1/12

[52] U.S. Cl. ..... 144/253.8; 144/253.5; 269/303

[58] Field of Search ..... 144/253.1, 253.2, 144/253.5, 253.8; 269/303, 315, 318

[56] References Cited

U.S. PATENT DOCUMENTS

| | | | |
|---|---|---|---|
| 2,619,998 | 12/1952 | Okamuro | 144/253.8 |
| 3,035,619 | 5/1962 | Gaskell | 144/253.1 |
| 4,971,123 | 11/1990 | Braunbach | 144/253.8 |
| 5,533,557 | 7/1996 | Jedlicka et al. | 144/253.5 |
| 5,611,525 | 3/1997 | Bishop | 269/303 |

*Primary Examiner*—W. Donald Bray

*Attorney, Agent, or Firm*—Browdy and Neimark

[57] ABSTRACT

A workpiece supporting assembly of a carpenter's plane is mounted on a workbench of the carpenter's plane and composed of a slide slot seat which is adjustably fastened with the carpenter's plane and provided with a first fastening member, a fastening seat mounted on the slide slot seat, a lock rod located at the side of the fastening seat and provided with a second fastening member, an angle adjusting member pivoted to the fastening seat, a grid plate pivoted to other side of the angle adjusting member and fastened with one end of the lock rod, and a fastening member having a first fastening portion which is connected with the first fastening member, and a second fastening portion which is connected with the second fastening member. When the fastening member is in operation, the first and the second fastening members are simultaneously arrested by the first and the second fastening portions, thereby causing the fastening seat to fasten with the slide slot seat and causing the lock rod to fasten with the fastening seat so as to fix the inclination of the grid plate.

2 Claims, 4 Drawing Sheets

WORKPIECE SUPPORTING ASSEMBLY OF CARPENTER'S PLANE

FIELD OF THE INVENTION

The present invention relates generally to a workpiece supporting assembly of a carpenter's plane, and more particularly to a control structure for simplifying the adjustment of the workpiece supporting assembly of the carpenter's plane.

BACKGROUND OF THE INVENTION

As shown in FIGS. 1 and 2, workpiece supporting assembly 100 of the carpenter's plane of the prior art is composed of a slide slot set 110 provided with a first fastening member 115, a fastening seat 120 mounted on the slide slot seat 110, and a grid plate 170 connected with the fastening seat 120 and provided with a lock rod 140 and an angle adjusting member 150. The fastening seat 120 is pivoted by a locking shaft 180 to a pivoting hole of the first fastening member 115. The lock rod 140 is locked by a second fastening member 145 via the fastening seat 120. The fastening seat 120 is adjusted and located by the locking shaft 180 in accordance with the various widths of the wood planing. The bevel of the grid plate 170 is adjusted and located by the second fastening member 145 for locating a wood at various angles.

The prior art structure described above is defective in design in that the simultaneous adjustments of the position of the fastening seat 120 and the bevel of the grid plate 170 are attained by the separate operations of the locking shaft 180 and the second fastening member 145. Such operations are tedious and time-consuming. In addition, the constructions of the locking shaft 180 and the second fastening member 145 result in an increase in the overall cost of making the carpenter's plane of the prior art.

SUMMARY OF THE INVENTION

It is therefore the primary objective of the present invention to provide a carpenter's plane with a workpiece supporting assembly which is easy to use.

It is another objective of the present invention to provide a carpenter's plane with a workpiece supporting assembly which is simple in construction.

In keeping with the principle of the present invention, the foregoing objectives of the present invention are attained by the workpiece supporting assembly consisting of a slide slot seat located in the middle of the upper portion of a carpenter's plane and provided with a first fastening member, a fastening seat located on the slide slot seat, a lock rod located at one side of the fastening seat and provided with a second fastening member, an angle adjusting member rotatably mounted on the fastening seat, a grid plate pivoted to the angle adjusting member and fastened with the lock rod, and a fastening member pivoted with the fastening seat and provided with a first fastening portion which is connected with the first fastening member. The fastening member further has a second fastening portion which is connected with the second fastening member.

By rotating the fastening member, the first fastening portion can arrest the first fastening member so as to fasten the fastening seat with the slide slot seat. In the meantime, the second fastening portion can arrest the second fastening member so as to fasten the angle adjusting member with the fastening seat. As a result, the inclination of the grid plate is set securely.

Preferably, the first and the second fastening portions of the fastening member are two columnar bodies which are perpendicular to each other and eccentric to their axes. The first and the second fastening members have a pivoting hole for receiving the first and the second fastening portions of the fastening member.

The features of the present invention will be more readily understood upon a thoughtful deliberation of the following detailed description of a preferred embodiment of the present invention with reference to the accompanying drawings.

DETAILED DESCRIPTION OF THE INVENTION

Figure 1:
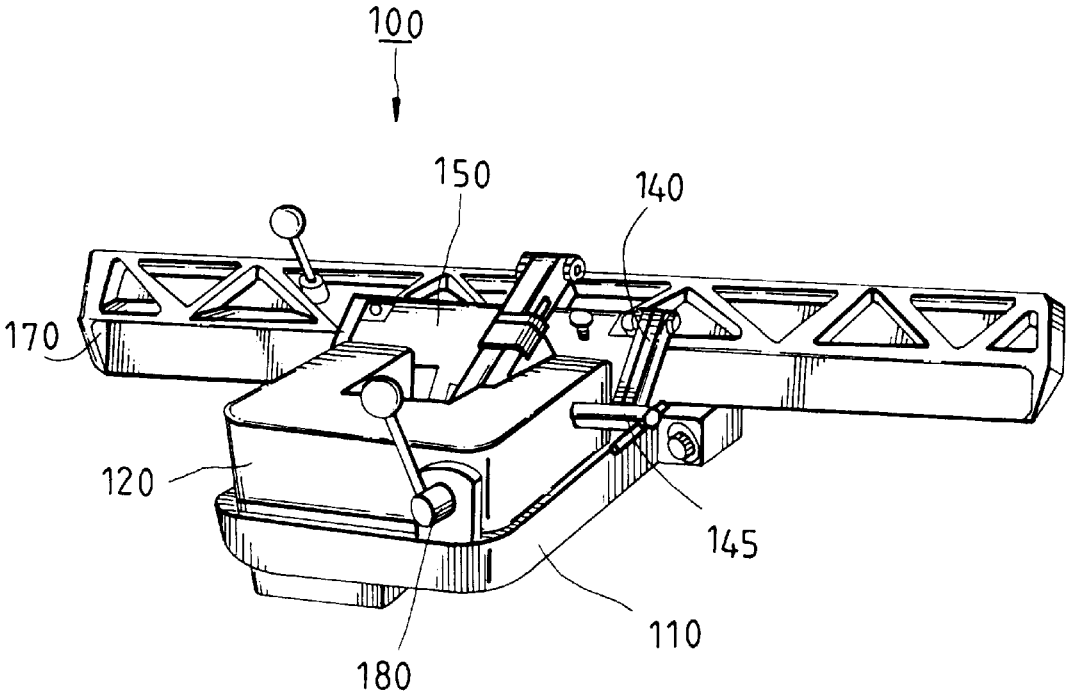
FIG. 1 PRIOR ART
FIG. 1 shows a perspective view of a workpiece locating assembly of a carpenter's plane of the prior art.
Figure 3:
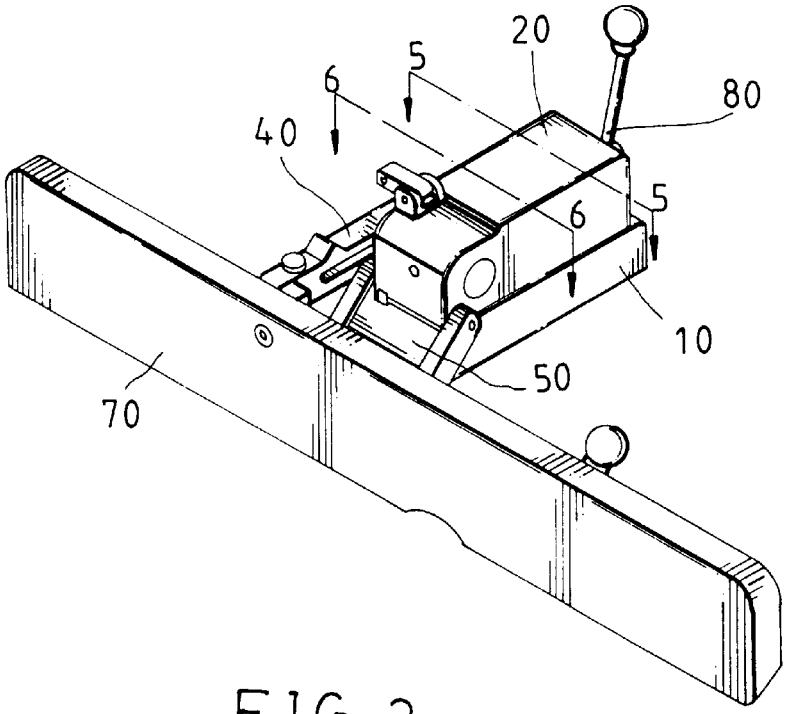
FIG. 3 shows a perspective view of the preferred embodiment of the present invention.
Figure 2:
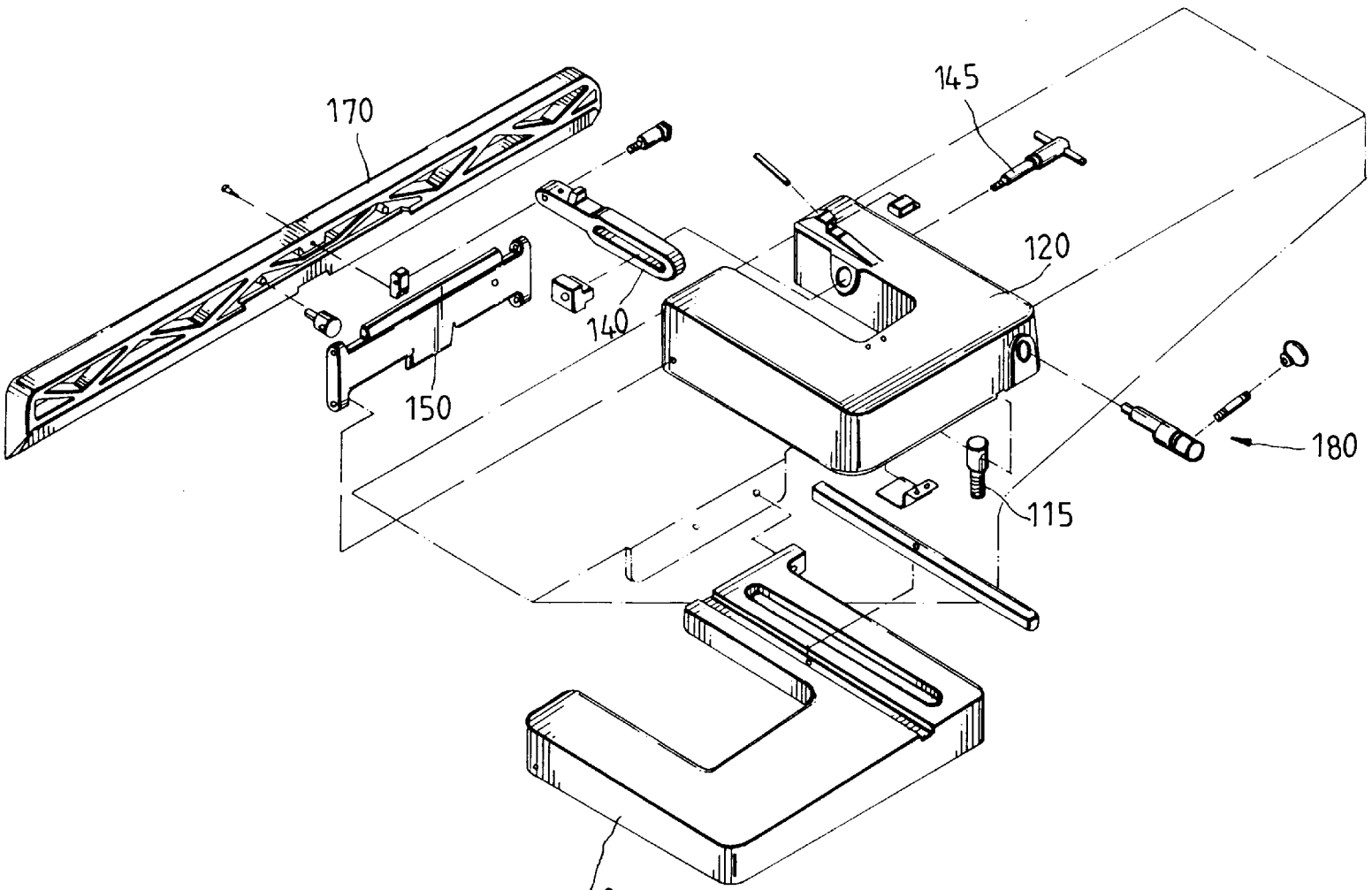
FIG. 2 shows an exploded view of the workpiece locating assembly of the carpenter's plane of the prior art.
Figure 4:
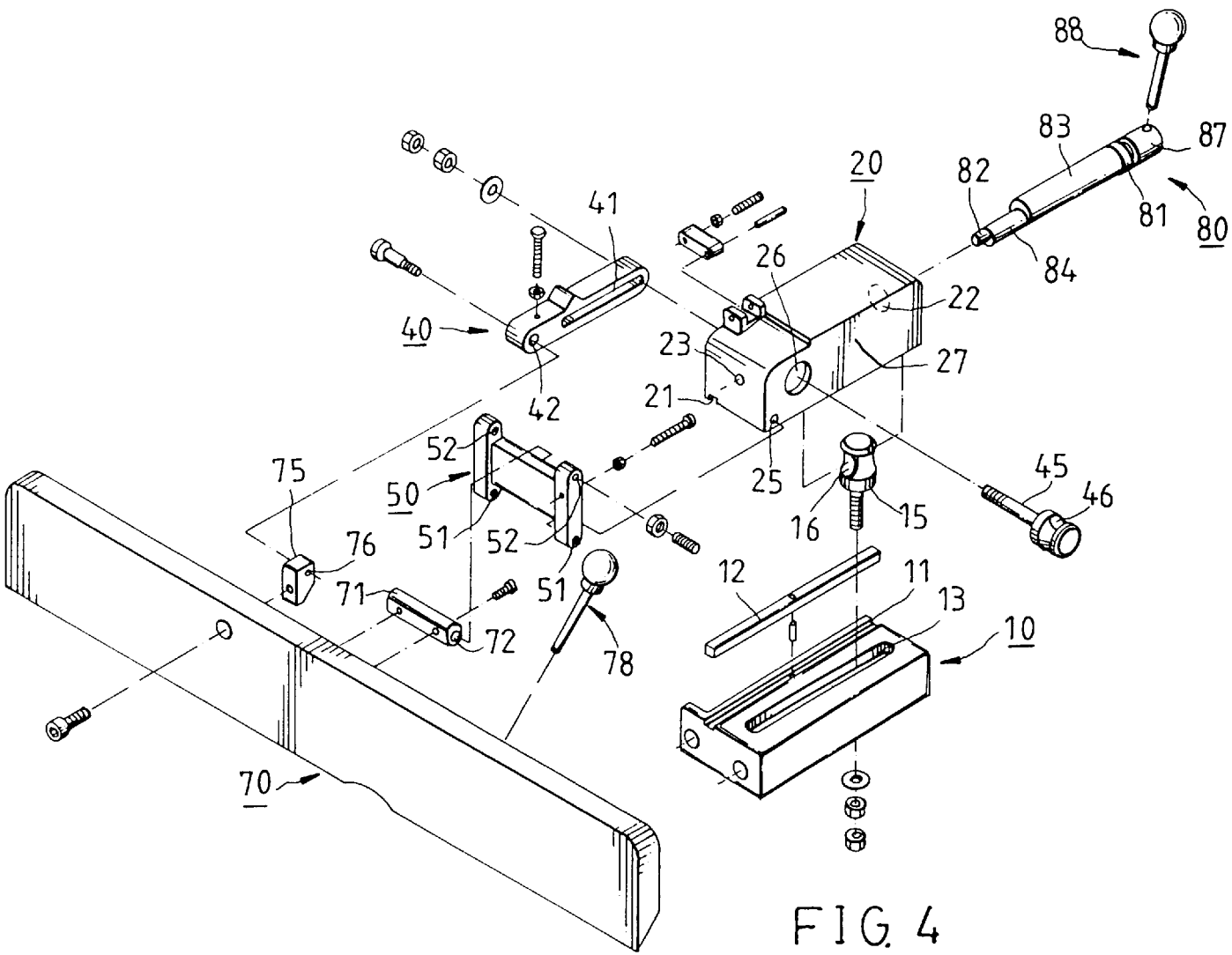
FIG. 4 shows an exploded view of the preferred embodiment of the present invention.

As shown in FIGS. 3 and 4, the preferred embodiment of the present invention comprises the component parts described hereinafter.

A slide slot seat 10 is adjustably fastened with the midsection of the upper portion of a carpenter's plane and is provided with a slide slot 11 having a rail 12, a longitudinal slot hole 13 which is engaged with a fastening member 15 having a pivoting hole 16. The slide slot seat 10 is fastened to the carpenter's plane by two bolts (not shown).

A fastening seat 20 is provided in the bottom thereof with a recessed space 27 having a slide slot 21 for disposing the rail 12 of the slide slot seat 10. The fastening seat 20 is further provided with a first axial hole 22 and a second axial hole 23 coaxial to the first axial hole 22, a pivoting hole 25 located at two sides of the lower end thereof, and a pivoting hole 26 located in the side thereof.

A lock rod 40 has a slot hole 41 which is engaged with a second fastening member 45 having a pivoting hole 46. The lock rod 40 further has a pivoting hole 42. The lock rod 40 is fastened with the fastening seat 20 such that the second fastening member 45 is received in the pivoting hole 26 of the fastening seat 20.

An angle adjusting member 50 has two first pivoting holes 51 and is fastened with the pivoting hole 25 of the fastening seat 20 by bolt such that the angle adjusting member 50 can rotate around the center of the pivoting hole 25. The angle adjusting member 50 is still provided with two second pivoting holes 52 opposite to each other.

A grid plate 70 has a pivoting portion 71 provided with an inner hole 72 which is engaged by bolt with each second pivoting hole 52 of the angle adjusting member 50. The grid plate 70 further has a locking portion 75 provided with a tooth hole 76 for a bolt to engage with the locking hole 42 of the lock rod 40, so as to fix the inclination of the grid plate 70. The grid plate 70 is further provided with an operation rod 78.

A fastening member 80 is sequentially provided with a head 87, a first shaft portion 81, a first fastening portion 83, a second fastening portion 84, and a second shaft portion 82. The head 87 is connected with the operation rod 88. The first fastening portion 83 is of a round diameter and eccentric to the axis of the first shaft portion 81. The second fastening portion 84 is of a round diameter and eccentric to the axis of the second shaft portion 82. The eccentric angles of the first and the second fastening portions 83 and 84 are 90 degrees. The first and the second shaft portions 81 and 82 are coaxial.

The first shaft portion 81 of the fastening member 80 is received in the first axial hole 22 of the fastening seat 20. The second shaft portion 82 is received in the second axial hole 23 of the fastening seat 20. The first fastening portion 83 of the fastening member 80 is pivoted with the pivoting hole 16 of the first fastening member 15. The second fastening portion 84 is pivoted in the pivoting hole 46 of the second fastening member 45.

The action form and the principle of the present invention are described hereinafter.

Figure 6:
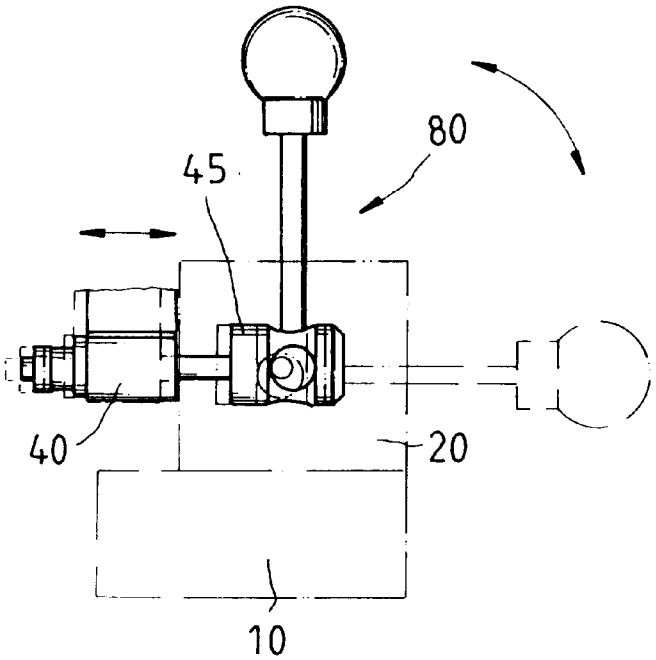
FIG. 6 shows a sectional view of a portion taken along the direction indicated by a line 6—6 as shown in FIG. 3.
Figure 5:
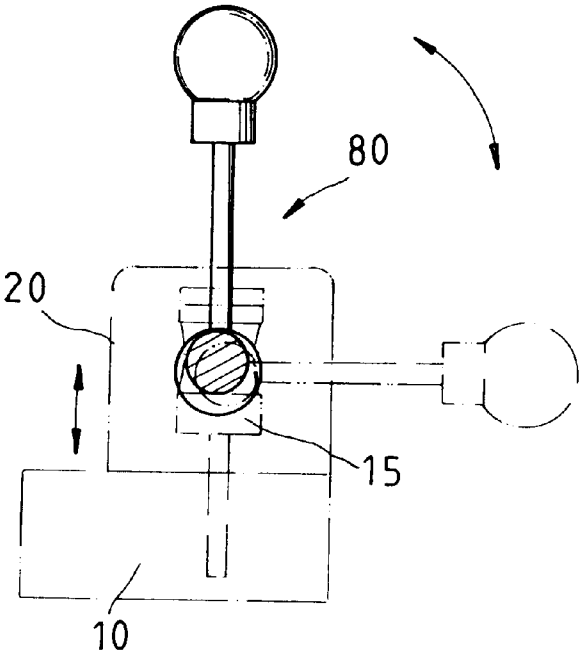
FIG. 5 shows a sectional view of a portion taken along the direction indicated by a line 5—5 as shown in FIG. 3.

As shown in FIG. 5, the fastening member 80 can swivel by means of the operation rod 88. The first fastening member 15 is eccentrically arrested by the first fastening portion 83. The fastening seat 20 is thus fastened with the slide slot seat 10. In the meantime, as shown in FIG. 6, the second fastening member 45 is eccentrically arrested by the second fastening portion 84 so as to cause the angle adjusting member 50 to fasten with the fastening seat 20. The inclination of the grid plate 70 is thus fixed.

The embodiment of the present invention is simple in operation in that only the fastening member 80 is operated to swivel, so as to fasten or unfasten the fastening seat 20 and the grid plate 70.

The advantages of the present invention are described hereinafter.

The fastening seat and the gird plate of the present invention can be adjusted and fastened at the same time by the first and the second fastening portions of the fastening member.

The first and the second fastening members are arrested by the fastening member. The present invention is thus simple in construction.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A workpiece supporting assembly of a carpenter's plane, said assembly comprising:

a slide slot seat fastened with a midportion of an upper portion of the carpenter's plane, and provided with a first fastening member;

a fastening seat located on said slide slot seat;

a lock rod located at one side of said fastening seat and provided with a second fastening member located in the direction toward said fastening seat;

an angle adjusting member pivoted at one side thereof to said fastening seat such that said angle adjusting member can swivel;

a grid plate pivoted to other side of said angle adjusting member and fastened at other end thereof with said lock rod such that said grid plate can be adjusted in inclination; and a fastening member fastened with said fastening seat and provided with a first fastening portion connected with said first fastening member;

wherein said fastening member is provided with a second fastening portion, which is connected with said second fastening member;

said first fastening member being arrested by said first fastening portion so as to cause said fastening seat to fasten securely with said slide slot seat at the time when said fastening member is rotated;

said second fastening member being arrested by said second fastening portion so as to cause said angle adjusting member to fasten securely with said fastening seat to fix an inclination of said grid plate at the time when said fastening member is rotated.

2. The assembly as defined in claim 1, wherein said first fastening portion and said second fastening portion of said fastening member are columnar bodies perpendicular to each other and eccentric to axis thereof; and wherein said first fastening member and said second fastening member are provided with a pivoting hole for receiving said first fastening portion or said second fastening portion of said fastening member.

* * * * *